US005678449A

United States Patent [19]

Mollet et al.

[11] Patent Number: 5,678,449

[45] Date of Patent: Oct. 21, 1997

[54] INTAKE-AND-GAUGING DEVICE FOR THE FUEL IN A MOTOR VEHICLE

[75] Inventors: Philippe Mollet, Villebon sur Yvette; Jean Brigliadori, Saint Germains en Laye; Jean Filjak, Epinays sur Seine, all of France

[73] Assignee: Marwal Systems, France

[21] Appl. No.: 431,904

[22] Filed: May 1, 1995

[30] Foreign Application Priority Data

May 5, 1994 [FR] France ..... 94 05524

[51] Int. Cl.[6] ..... F02M 37/10

[52] U.S. Cl. ..... 73/319; 73/118.1; 73/301; 73/306; 73/313; 73/317; 73/322.5

[58] Field of Search ..... 73/301, 305, 306, 73/307, 308, 313, 317, 319, 118.1, 320, 322, 322.5

[56] References Cited

U.S. PATENT DOCUMENTS

| | | | |
|---|---|---|---|
| 338,832 | 3/1886 | Dinsmore | 73/306 |
| 1,237,426 | 8/1917 | Wales | 73/306 |
| 1,768,946 | 7/1930 | Anschicks | 73/306 |
| 3,906,795 | 9/1975 | Kask | 73/309 |
| 4,129,039 | 12/1978 | Pignato | 73/320 |
| 4,945,884 | 8/1990 | Coha et al. | 123/509 |
| 5,142,908 | 9/1992 | Chamblin, Sr. et al. | 73/320 |

FOREIGN PATENT DOCUMENTS

| | | |
|---|---|---|
| 0 246 755 | 4/1987 | European Pat. Off. . |
| 2 636 017 | 9/1989 | France . |
| WO 90/13739 | 4/1990 | WIPO . |

OTHER PUBLICATIONS

J.C. Whitney catalog, winter 1995–1996, p. A3 (showing fuel gauges).

*Primary Examiner*—George M. Dombroske
*Attorney, Agent, or Firm*—Blakely Sokoloff Taylor & Zafman

[57] ABSTRACT

The present invention relates to an intake-and-gauging device for the fuel in a motor vehicle, the device comprising a fixing base designed to be fixed on a wall of a fuel tank and carrying an intake assembly provided with a reserve receptacle and a gauging assembly, wherein the gauging assembly is slidably mounted in a generally vertical direction on the reserve receptacle and is resiliently urged towards the bottom of the relative to said receptacle.

38 Claims, 10 Drawing Sheets

200
210
212
214
216
220
232
234
260
272
310
330
350
352
370
371
372
373
374
375
376
377
378
380
396
398
400

310
320
322
323
324
326
330
332
340
350
352
354
370
371
372
373
374
375
376
377
378
300
312
325

INTAKE-AND-GAUGING DEVICE FOR THE FUEL IN A MOTOR VEHICLE

The present invention relates to the field of intake-and-gauging devices for fuel in a motor vehicle.

BACKGROUND OF THE INVENTION

Numerous devices have already been proposed for gauging and intake of fuel for motor vehicles.

In general , such devices comprises a module provided with a base that is designed to be fixed on a wall of a tank, generally the top wall thereof.

the gauging means generally comprise a float pivotally mounted on a housing to track the level of fuel. The float carries a cursor which is moved over a resistive track to provide information representative of the level and/or the volume of fuel contained in the vehicle tank.

The intake means generally comprise an electric pump or merely an intake tube which is generally dipped in a reserve receptacle so as to avoid unprimimg the system.

proposals have also been made, over many years, to guide the assembly comprising the gauge means and the intake means relative to its fixing base and to urge said assembly resiliently against the bottom of the fuel tank so that the gauging and intake assembly is indexed against the bottom of the tank. Such a disposition makes it possible firstly to provide reliable information about the measured level, at least when fuel is low, and regardless of how much the bottom of the tank may be deformed.

It is known that nowadays fuel tanks are often made of plastics material and that such tanks can be subject to considerable deformation, in particular under the effect of the weight of fuel or also of aging of the material from which the tank is made. By indexing the assembly of gauging and intake means relative to the bottom of the tank, it is also possible to guarantee that fuel will indeed be sucked up, i.e. to avoid premature unpriming, even in the event of the bottom of the tank moving down a long way relative to the top wall of the tank which supports the fixing base.

A detailed description of the structure of such known intake and gauging devices can be found in the following documents: FR-A-2 579 678, EP-A-120343, EP-A-203244, and U.S. Pat. No. 4,869,225.

Each of those devices is quite complex in structure.

OBJECTS AND SUMMARY OF THE INVENTION

Consequently, an object of the present invention is to improve existing devices.

This object is achieved by the present invention by means of an intake-and-gauging device for the fuel in a motor vehicle, the device comprising a fixing base designed to be fixed on a wall of a fuel tank and carrying an intake assembly provided with a reserve receptacle and a gauging assembly, wherein the gauging assembly is slidably mounted in a generally vertical direction on the reserve receptacle and is resiliently urged towards the bottom of the relative to said receptacle.

BRIEF DESCRIPTION OF THE DRAWINGS

Other characteristics, objects, and advantages of the present invention appear on reading the following detailed description made with reference to the accompanying drawings that are given by way of non-limiting example, and in which:

FIGS. 19 and 20 are two opposite perspective views of a support leg for the assembly;

FIGS. 21 and 22 are two opposite perspective views of a housing for said assembly;

FIG. 23 is a side view of the support leg;

FIG. 24 is a longitudinal section view of the support leg;

FIG. 25 is a side view of the support leg, in a view opposite to that of FIG. 23;

FIG. 26 is another side view of the support leg, and orthogonal to both FIGS. 23 and 25;

FIG. 27 is a side view of the housing; and

FIG. 28 is a cross-section view through the support leg on a section plane referenced XXVIII—XXVIII.

MORE DETAILED DESCRIPTION

Figure 2:
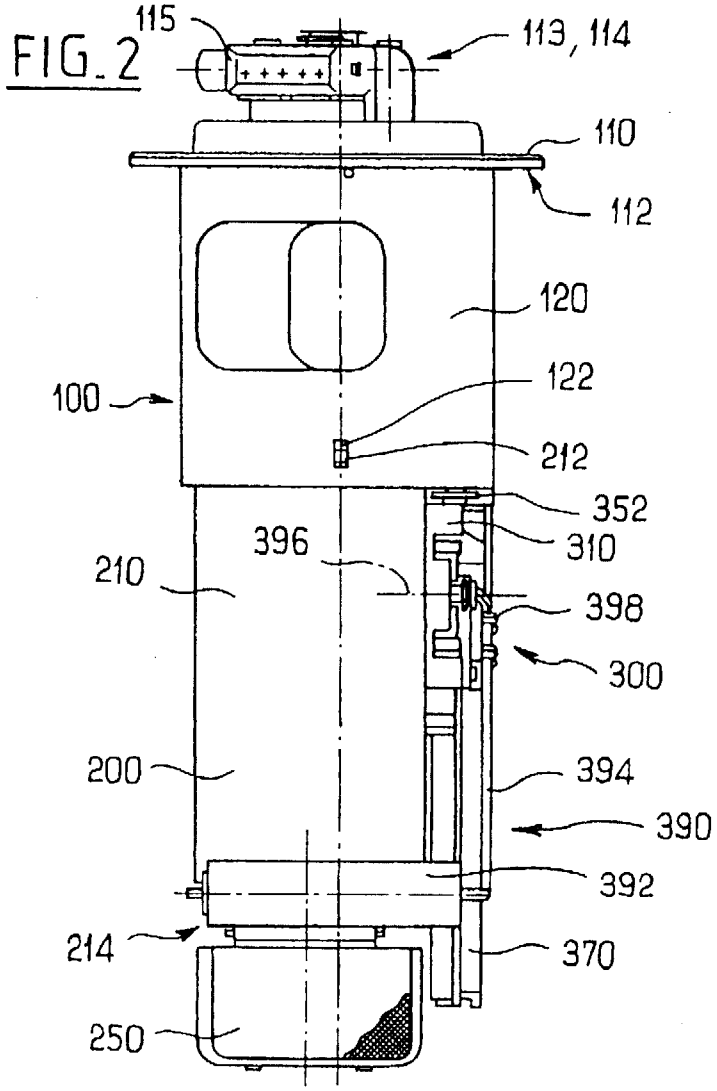
FIG. 2 is a second side view, orthogonal to FIG. 1, showing the same device for intake and gauging of fuel.
Figure 1:
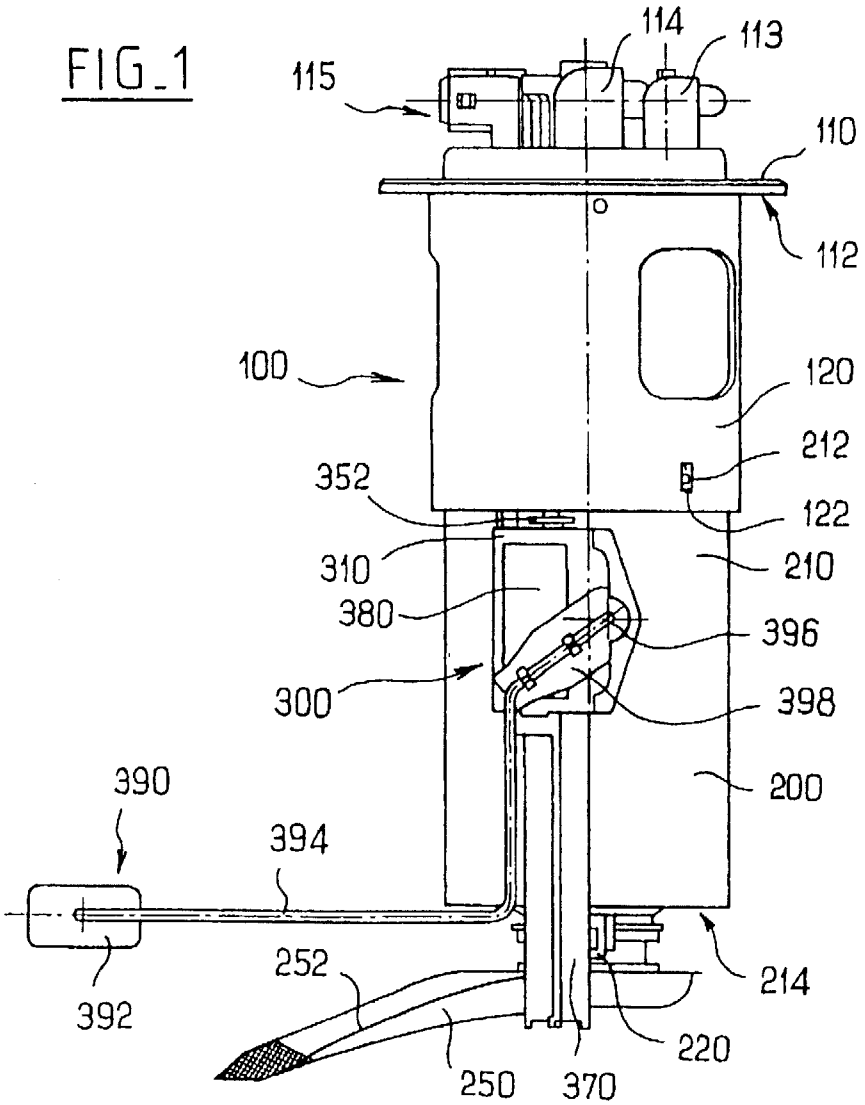
FIG. 1 shows a first diagrammatic side view of a device for intake and gauging of fuel in accordance with the present invention.

Accompanying FIGS. 1 and 2 provide an overall view of a device of the invention for gauging-and-intake.

FIGS. 1 and 2 show a device which comprises a base 100, an intake assembly 200, and a gauging assembly 300.

The base 100 is preferably made by molding a plastics material. It may be implemented in numerous different ways.

Preferably, the base 100 includes a top collar 110 which is generally plane and adapted to be fixed on the top wall of a fuel tank. This collar 110 is extended on its bottom surface 112 by a generally cylindrical skirt 120 which has fixed thereto, advantageously by snap-fastening, the top of a reserve receptacle 210 integrated in the intake assembly 200. For this reason, the reserve receptacle 210 is advantageously provided at its top with teeth or lugs 212 adapted to engage in complementary through windows 122 formed in the base of the skirt 120.

In conventional manner, the collar 110 is provided with through tubes 113 and 114 that serve to convey fuel to a point of use (a carburetor or an injector), and to return excess fuel back to the tank, preferably into the reserve receptacle 200.

The collar 110 of the base 100 is also provided with an electrical connector 115 for making connections to the electrical pump placed inside the receptacle 200 and to the gauging assembly 300.

The intake assembly 200 comprises a receptacle 210, as mentioned above. The receptacle 210 is advantageously molded out of plastics material.

The base of the receptacle 210 has a through bore which communicates with the fuel tank. More precisely, the receptacle 210 presents, preferably in its base 214, an endpiece 216 having a filter or strainer 250 engaged therein.

Preferably, the receptacle 210 is provided in the endpiece 216 with an anti-emptying valve which prevents fuel flowing freely from inside the reserve receptacle 210 into the inside volume of the fuel tank, while nevertheless allowing fuel to flow in the opposite direction from the fuel tank into the inside volume of the receptacle 210.

The filter or strainer 250 may be implemented in numerous different ways. Nevertheless, in the context of the present invention, it must be sufficiently flexible to allow for deformation over a vertical amplitude that is not less than the maximum amplitude of deformation to which the bottom wall of the fuel tank may be subjected.

Furthermore, the filter or strainer 250 advantageously preferably houses an internal resilient structure which urges said filter or strainer 250 to bear against the bottom wall of the tank. In FIG. 1, this resilient structure is shown diagrammatically under reference 252.

Because the filter or strainer 250 is urged against the bottom wall of the tank, any unpriming of the intake assembly is avoided, regardless of how much the tank becomes deformed.

Typically, the filter or the strainer 250 are adapted to accommodate deformation over a vertical amplitude of about 40 mm to 60 mm.

In practice, the resilient structure 252 may be constituted by a helical spring supported by the endpiece 216 and placed in the filter or the strainer 250.

Nevertheless, according to an advantageous characteristic of the invention, the resilient structure 252 is constituted by a tab that is integrally molded in the same plastics material as the endpiece 216 or the bottom wall of the receptacle 210.

As suggested above, gasoline versions of the receptacle 210 house an electrically-controlled pump whose outlet is connected to the outlet tube 113.

In contrast, in diesel versions, the intake tube may merely be extended by a pipe dipping into the bottom of the reserve receptacle 210. Under such circumstances, a pump is not required.

The strainer or filter 250 may be held in place on the endpiece 216 by any appropriate means. The filter or the strainer 250 is preferably held by snap-fastening onto tabs having holes and referenced 220 in the accompanying figures. The tabs 220 are integrally molded in the base of the receptacle 210.

Figure 7:
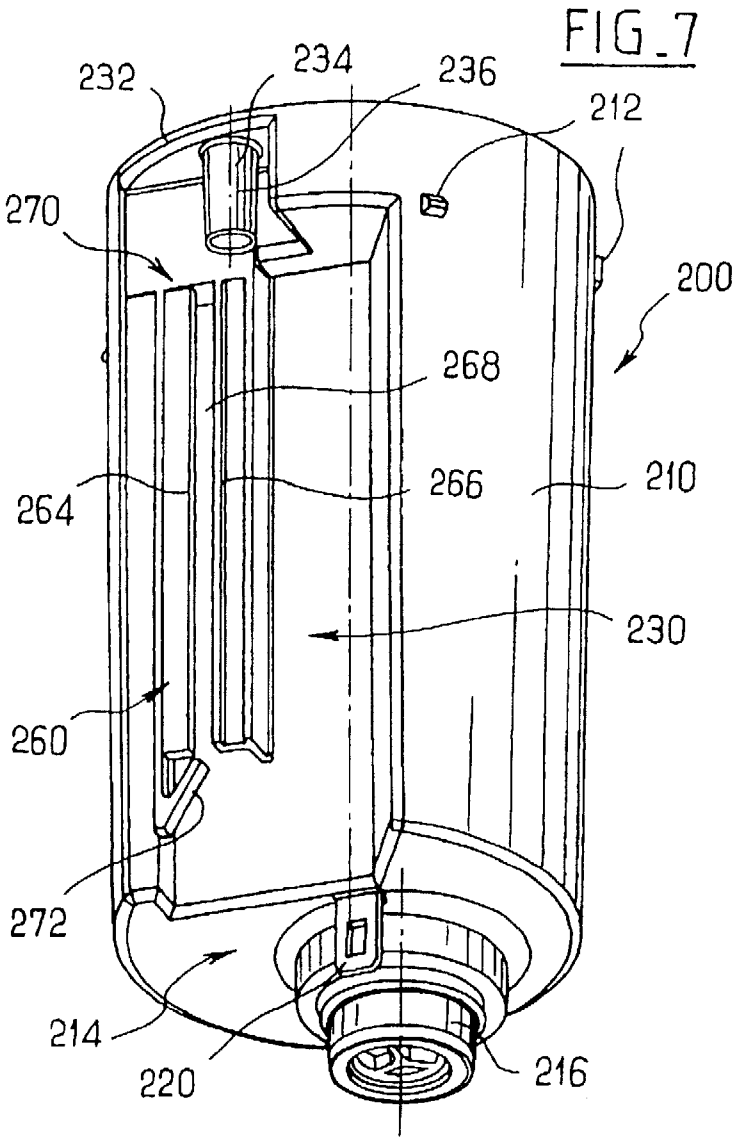
FIG. 7 is a perspective view of the reserve receptacle.
Figure 6:
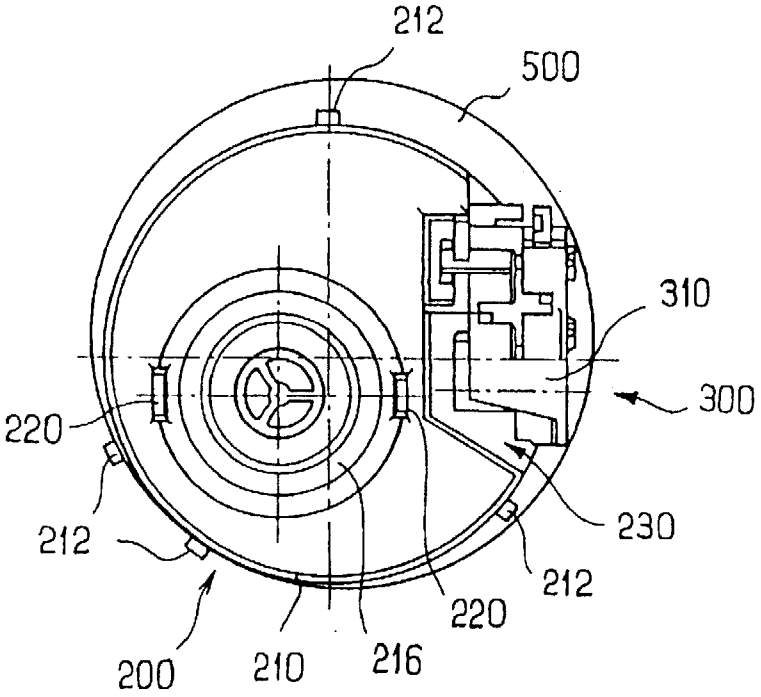
FIG. 6 is a bottom view of the reserve receptacle fitted with the gauging assembly of the present invention.
Figure 9:
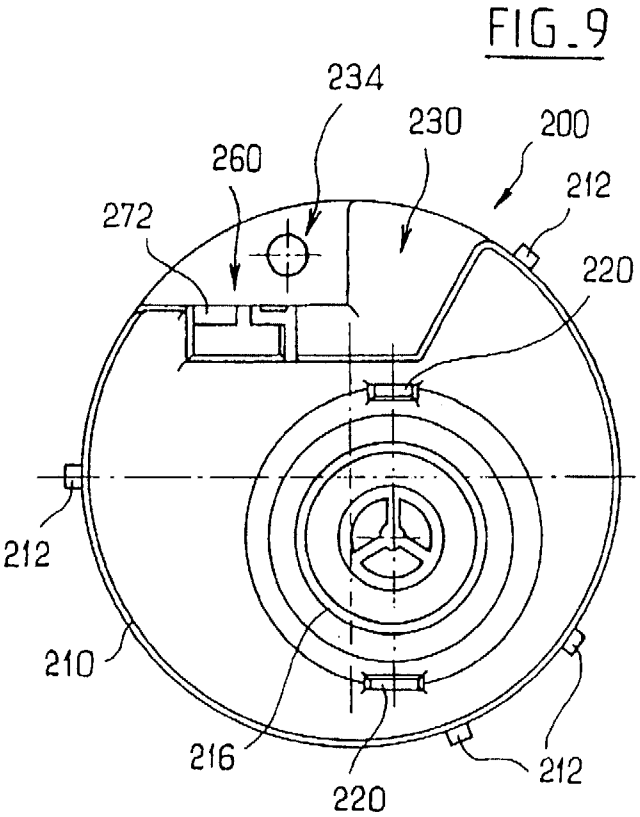
FIG. 9 is a bottom view of the reserve receptacle.
Figure 8:
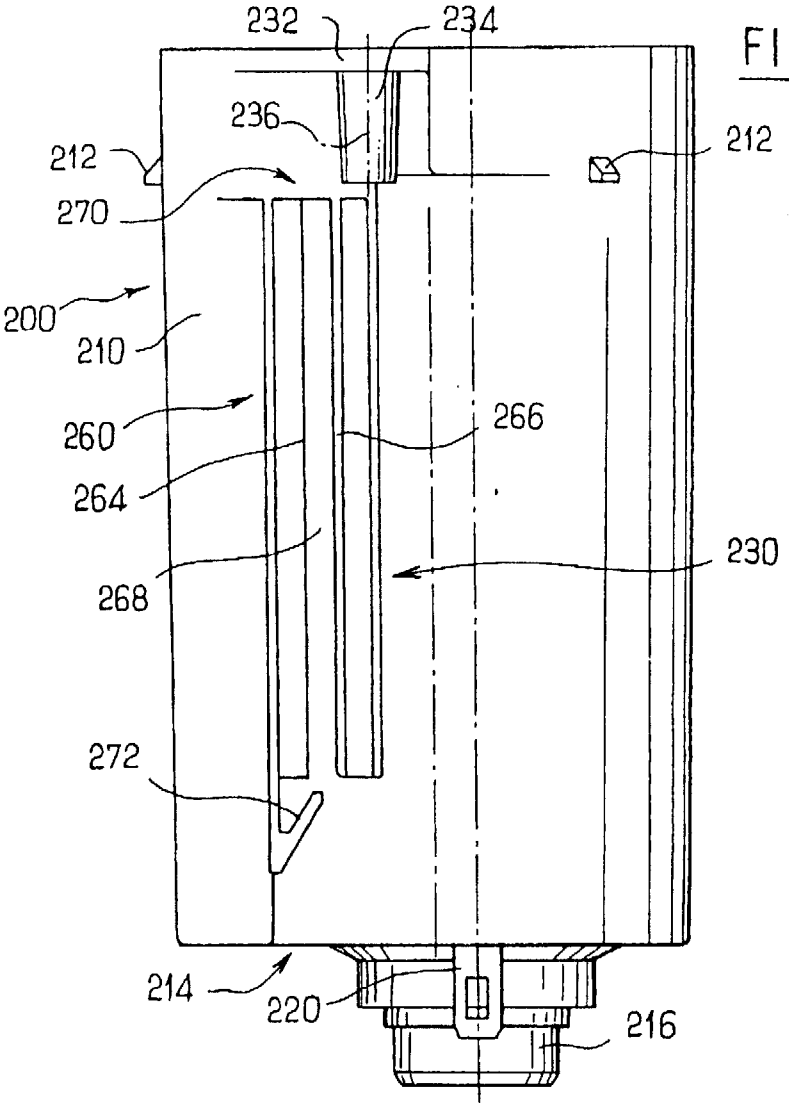
FIG. 8 is a side view of the reserve receptacle.

As can be seen, in particular in FIGS. 6 and 7, the receptacle 210 has a right cross-section that is generally circular about a vertical axis. However, it may be observed that the receptacle 210 has an inwardly directed setback 230 in its outside surface designed to receive the gauging assembly 300.

The setback 230 is preferably provided in the vicinity of one of its vertical edges with a vertical slideway 260 that is designed to receive the gauging assembly 300 in vertical sliding.

The slideway 260 may be implemented in numerous different ways. Preferably, as can be seen in particular in FIG. 7, the vertical slideway 260 comprises a groove of rectangular right section, having symmetrical converging edges 264 and 266 i.e. having a central longitudinal channel with an opening 268.

The slideway 260, and more particularly the channel 268, are closed at one end, preferably the top end, by a structure that is referenced 270 in FIG. 7.

Thus, the gauging assembly 300 is engaged on the slideway 260 via the bottom end thereof. A resilient tooth 272 is provided at the bottom end in the setback 230.

The resilient tooth 272 is designed to bend out of the way while the housing 310 of the gauging assembly 300 is being engaged in the slideway 260, and serves subsequently to prevent said gauging assembly 300 from being removed by mistake.

In practice, the tooth 272 may be formed, for example, by a rectilinear finger sloping at about 30° to 45° relative to the longitudinal direction of the slideway 260, with the free end of the finger 272 extending towards the end of the channel 268. This free end of the finger 272 is thus preferably located so that it faces the bottom end of the channel 268.

The top end of the setback 230 is closed by a collar 232 which carries a hollow socket 234 centered on a vertical axis 236, i.e. on an axis that is parallel to the central axis of the receptacle 210.

The socket 234 serves essentially to perform three functions: firstly it serves as a guide for a spring 400 which urges the gauging device 300 towards the bottom of the tank; secondly it serves as a guide for the gauging assembly 300 itself; and finally it serves as a top abutment for said gauging device 300.

To this end, the right section of the internal channel formed in the socket 234 is adapted to the section of a barrel 350 formed on the housing of the gauging assembly 300.

Figures 10, 11, 16, 17, 18:
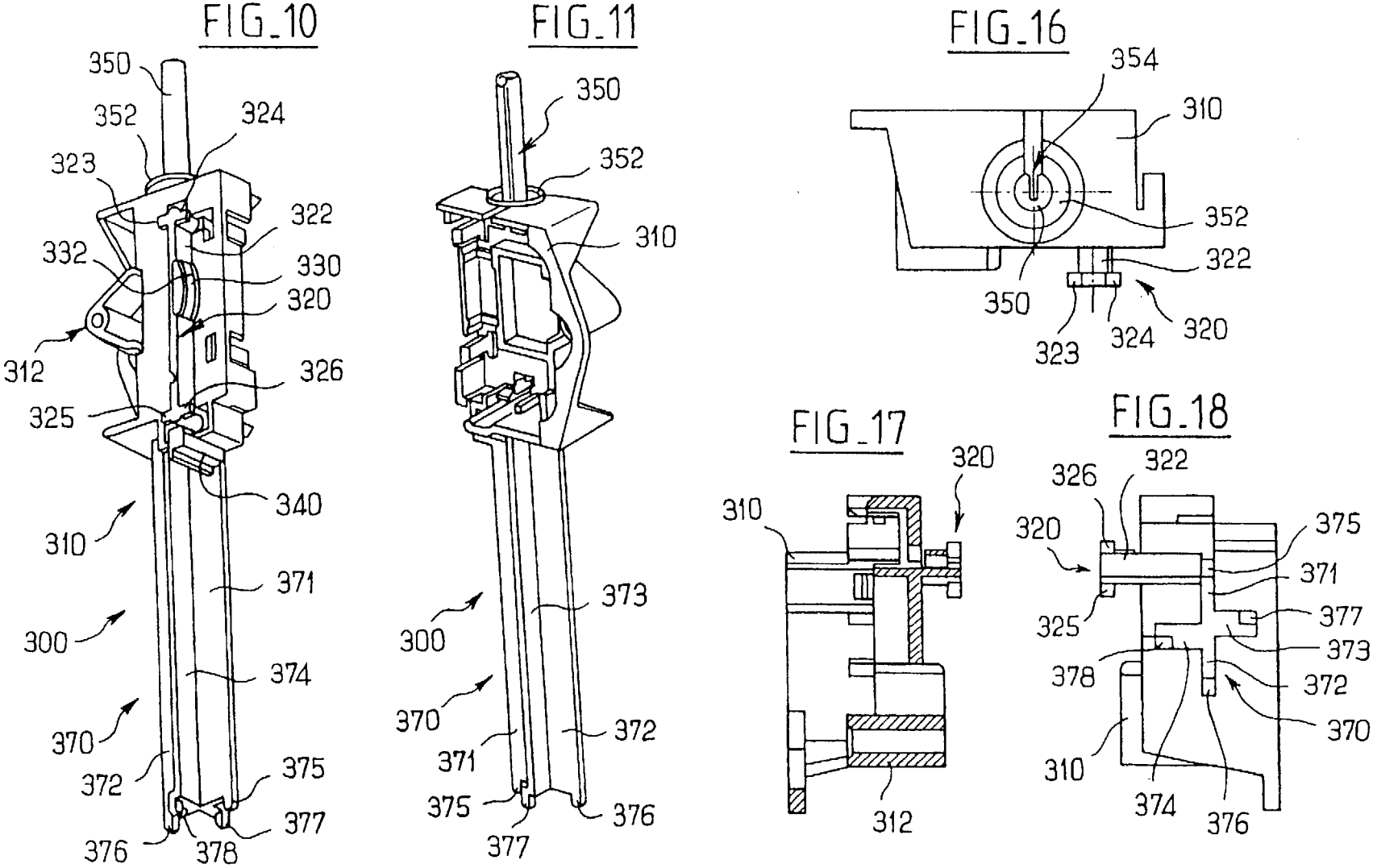
FIGS. 10 and 11 are two perspective views of housing for the gauging assembly of the present invention.
FIG. 16 is a top end view of the same housing.
FIG. 17 is a cross-section view through the same housing, on the section plane referenced XVII—XVII in FIG. 12.
FIG. 18 is a bottom end view of the same housing of the present invention.
Figure 12:
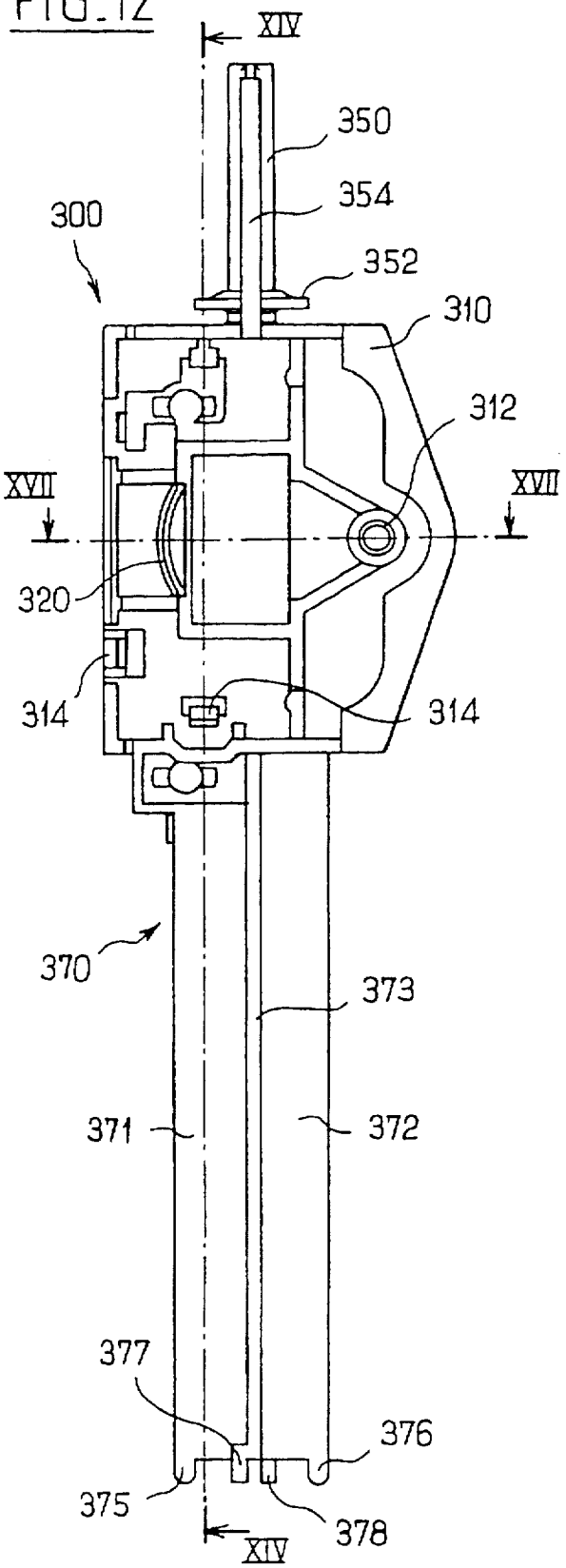
FIG. 12 is a side view of the same housing for the gauging assembly.
Figure 13:
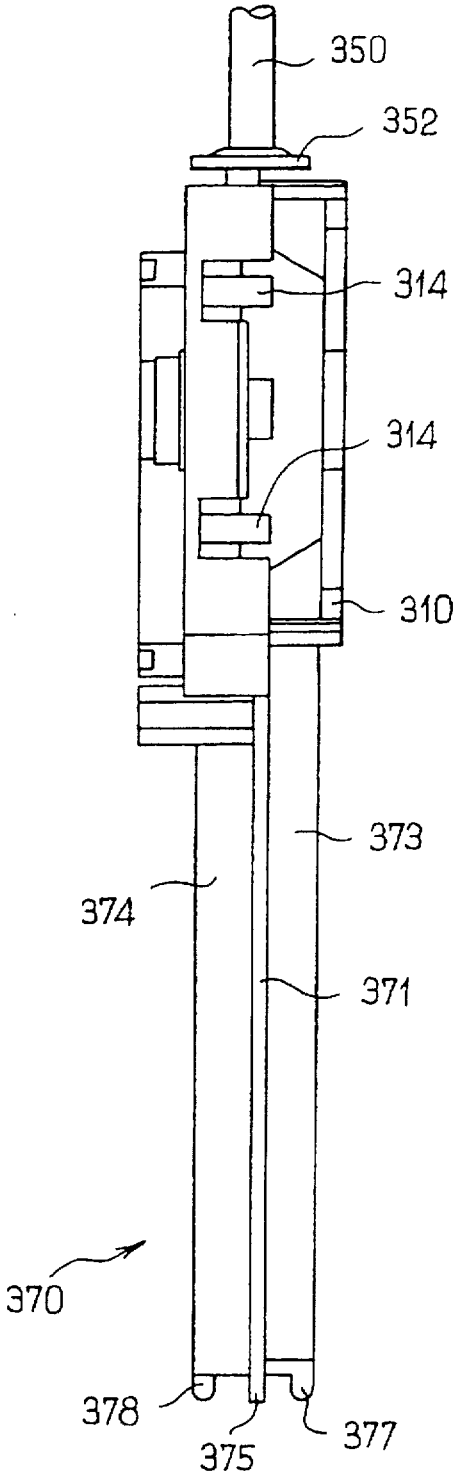
FIG. 13 is a view orthogonal to FIG. 12 and showing the same housing.

The gauging assembly 300 essentially comprises a housing 310 as shown in FIG. 10 et seq., a float assembly 390, and a resistive track represented diagrammatically under reference 380 in FIG. 1.

Figures 3, 4, 5:
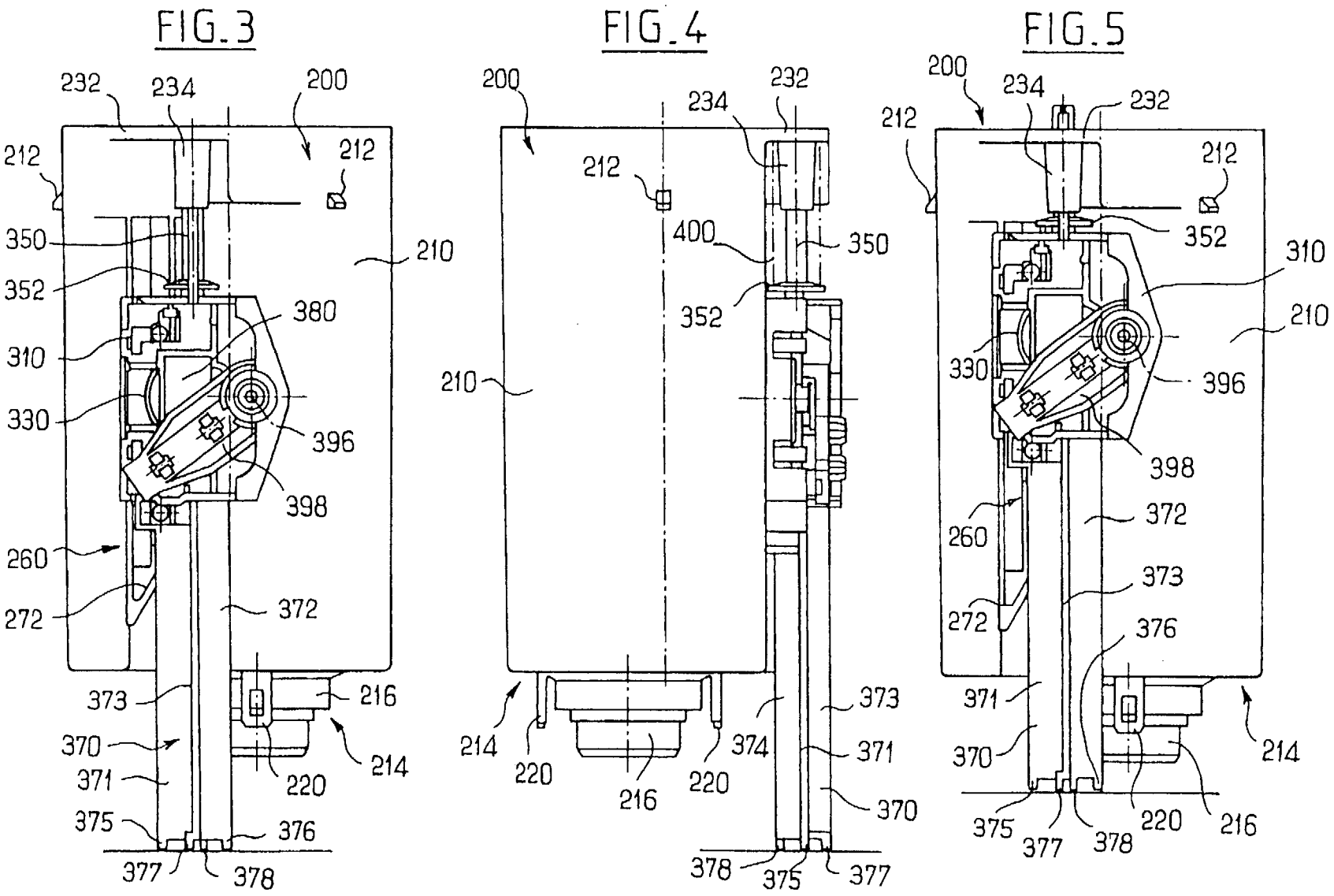
FIG. 3 is a side view similar to FIG. 1 showing the receptacle of a tank fitted with a gauging assembly of the present invention.
FIG. 4 is a second side view, similar to FIG. 2, i.e. orthogonal to FIG. 3, showing the same reserve receptacle fitted with a gauging assembly of the invention.
FIG. 5 is a view similar to FIG. 3 applicable to the bottom of the tank being raised relative to FIG. 3.

The float assembly 390 is of conventional structure per se. This assembly 390 essentially comprises a float 392 carried by an arm 394 pivoted about a horizontal axis 396 on the housing 310. The arm 394 (or where appropriate a plastics plate 398 associated with the arm and visible in FIGS. 1, 3, and 5) carries an electrically conductive slider that is guided to move over the resistive track 380.

In practice, the resistive track 380 may be constituted by a thick layer deposited on an electrically insulating support, e.g. a ceramic support.

Thus, in conventional manner, it is possible to extract information from said resistive track 380 and the slider associated with the plate 398 or the arm 394, which information is representative of the level and/or the volume of fuel contained in the tank.

The housing 310 of the gauging assembly 300 essentially comprises a central housing provided with a top barrel 350 as mentioned above, together with a bottom leg 370.

The central housing 310, the barrel 350, and the leg 370 are preferably constituted by a single molding of plastics material.

The central housing 310 may be implemented in numerous different ways. In particular, it may include, integrally molded therewith, a stub axle 312 centered on above-specified axis 396 and serving to guide the float arm 394 and also the plate 398 associated therewith.

In addition, the central housing 310 preferably includes various toothed resilient tongues 314 designed for securing the support of the resistive track 380.

On one of its main faces, as visible in particular in FIG. 10, the central housing 310 includes a guide 320 designed to be guided in the slideway 260 of the receptacle 210. Preferably, and in non-limiting manner, the guide 320 comprises a rectilinear vertical wall 322. The wall 322 is provided respectively at its top and bottom ends, and at its outer edge remote from the wall of the housing 310 with pairs of opposing fingers 323, 324, 325, and 326.

The fingers 323 and 325 thus project over one of the flanks of the wall 322 respectively from the top and bottom ends thereof. Symmetrically, the fingers 324 and 326 project over the other flank of the same wall 322, respectively from its top and bottom ends.

The width of the wall 322 is less than the width of the channel having the opening 268 in the slideway 260. In addition, the width occupied by the fingers 323, 324 and also by the fingers 325, 326, as measured perpendicularly to the wall 322 is less than the width of the main groove of the slideway 260, while being greater than the width of the above-mentioned channel of opening 268.

It will thus be understood that when the fingers 323, 324, 325, and 326 are engaged in the slideway 260 by resilient deformation of the tooth 272, the housing 310 is held on the slideway 260 while remaining free to slide vertically relative thereto.

It will be understood that the above-specified guide 320 has a T-shaped right cross-section at its top and bottom ends with the crossbar of the Ts being formed by the pairs of fingers 323 & 324 and 325 & 326 respectively. Between these ends having a T-shaped right section, the guide 320 has a right section in the form of a rectilinear bar.

Relative to a guide structure 320 having a constant T-shaped cross-section over its entire height, the use of simple fingers 323, 324, 325, and 326 on the ends of the guide 320 facilitates engagement of the housing 310 on the slideway 260 and restricts the amount of resilient stress that results from the tooth 272.

In addition, the guide 320 is preferably provided with a resilient member 330 bearing against one of the flanks of the slideway 260 to urge the guide 320 against the opposite flank of the slideway 260.

This resilient structure makes it possible to eliminate play between the housing 310 and the receptacle 210, and consequently to limit the noise generated by the system in operation.

This resilient structure can be implemented in numerous different ways.

In the preferred embodiment of the invention, the resilient structure 330 is in the form of an arc 332 constituted by a cylindrical sector integrally molded on one of the flanks of the wall 322.

The arc 332 is thus connected on said flank of the wall 322 via its top and bottom ends respectively. The arc 332 is centered on an axis that is generally horizontal.

The arc 332 is preferably provided substantially halfway along the wall, i.e. at substantially equal distances from the top pair of fingers 323, 324 and the bottom pair of fingers 325, 326.

It will also be observed that it is preferable for the housing 310 to be provided at its base with a setback or hook 340 situated facing the top of the tooth 272 and deigned to serve as a bearing point against said tooth so as to prevent it from bending. Thus, the co-operation defined between the setback 340 and the tooth 272 prevents, completely safely, the housing 310 from escaping from the slideway 260.

After assembly the setback 340 is of no use. However, prior to assembly, the setback 340 makes it possible to guarantee that the housing 310 is held on the receptacle 210.

The leg 370 integrally molded with the bottom portion of the housing 310 is designed to bear resiliently against the bottom of the tank under urging from the spring 400.

Figure 14:
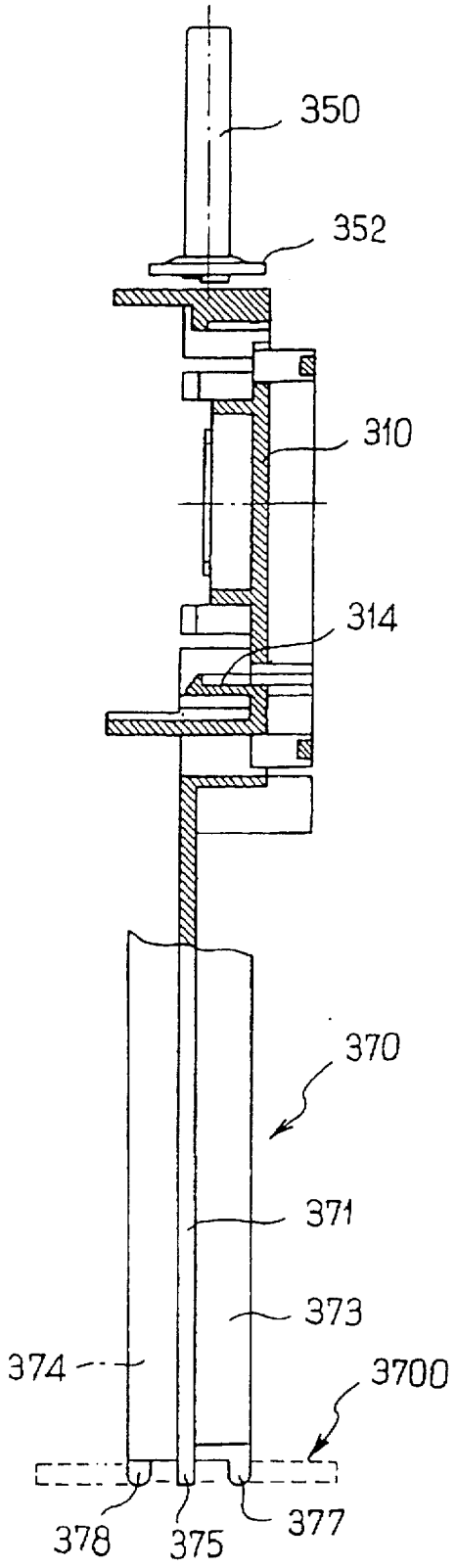
FIG. 14 is a section view through the same housing on the section plane referenced XIV—XIV in FIG. 12.
Figure 15:
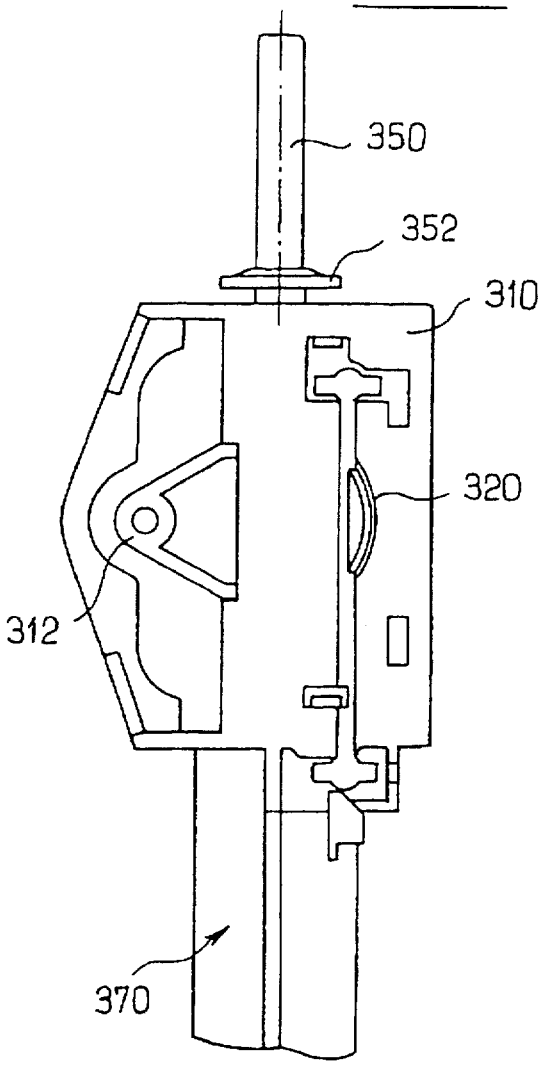
FIG. 15 is a side view of the same housing showing the opposite side to FIG. 12.
Figure 19:
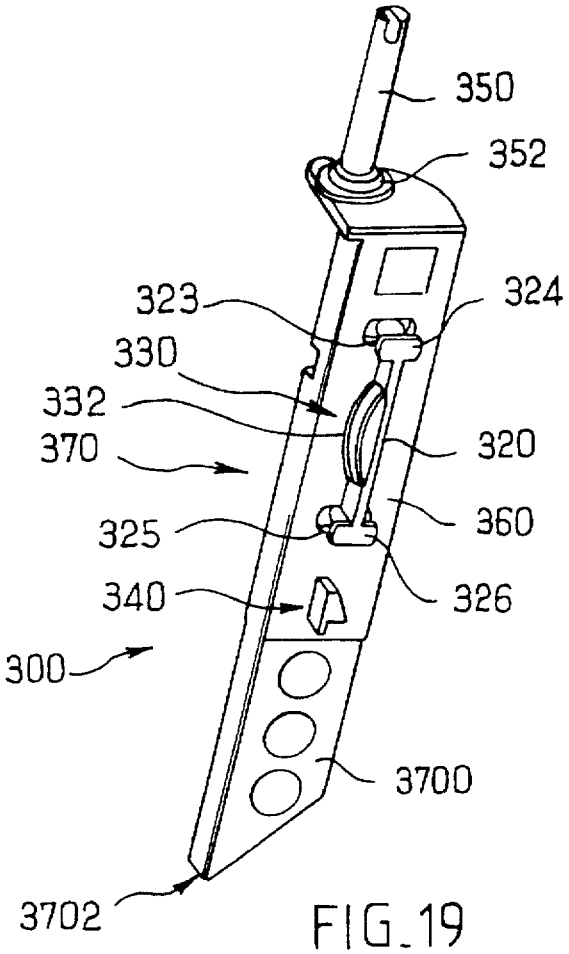
FIGS. 19 to 28 show a gauging assembly comprising a variant of the present invention, and more particularly.
Figure 20:
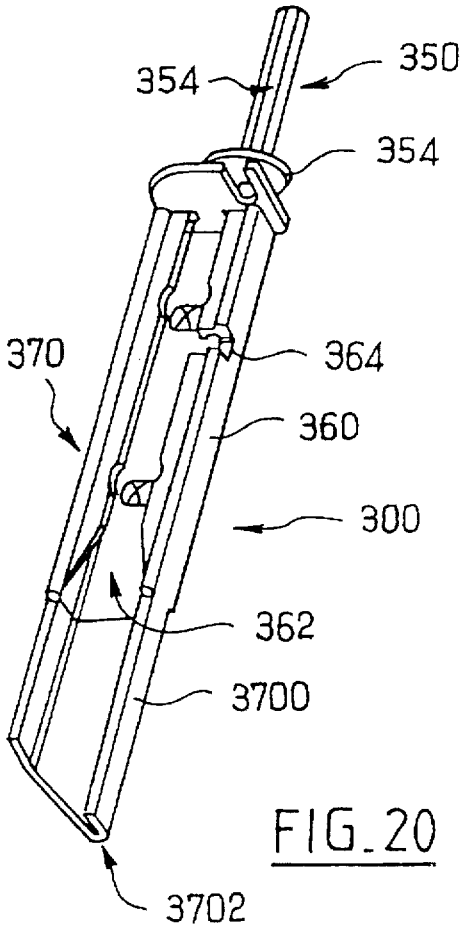
Figure 21:
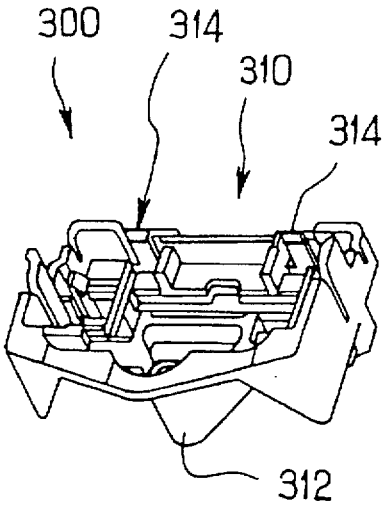
Figure 22:
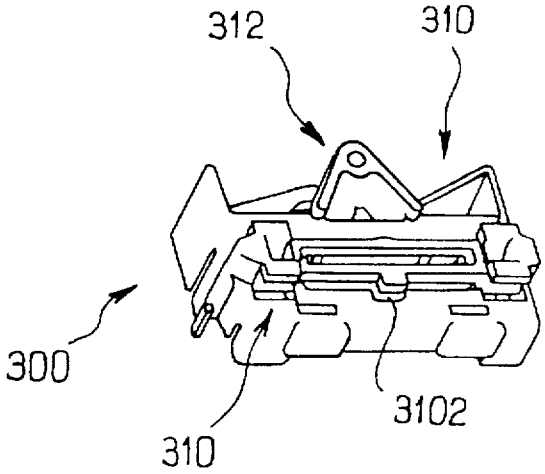
Figure 26:
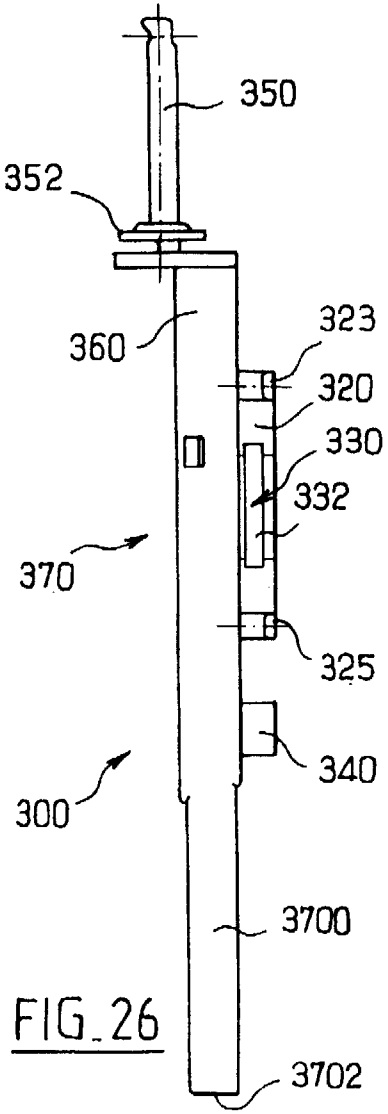
Figure 25:
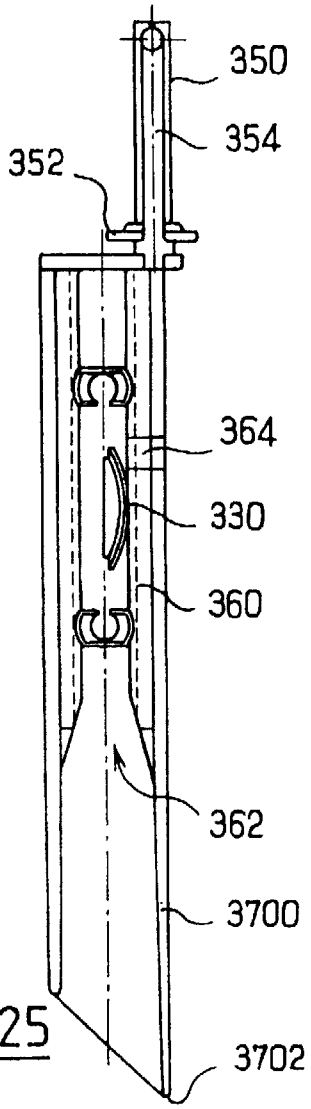
Figure 24:
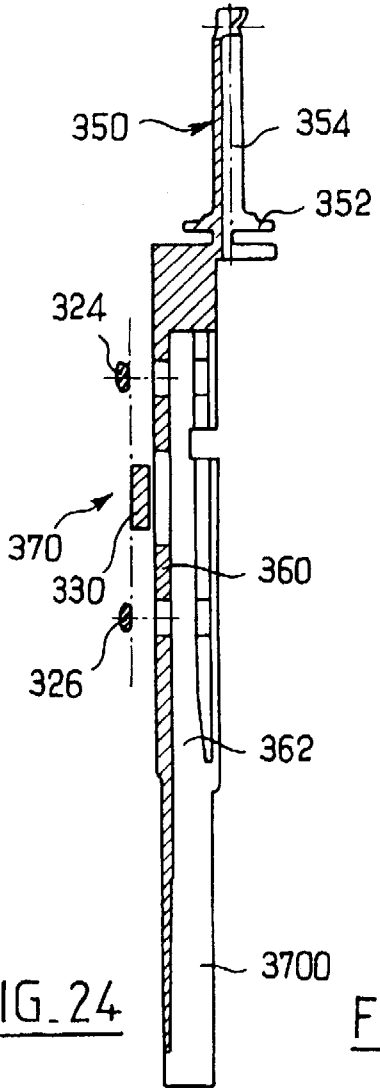
Figure 23:
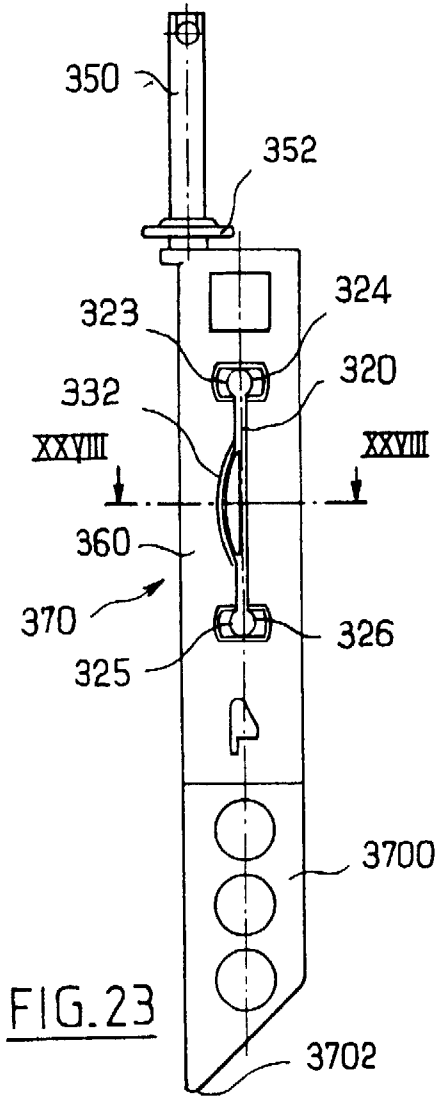
Figure 27:
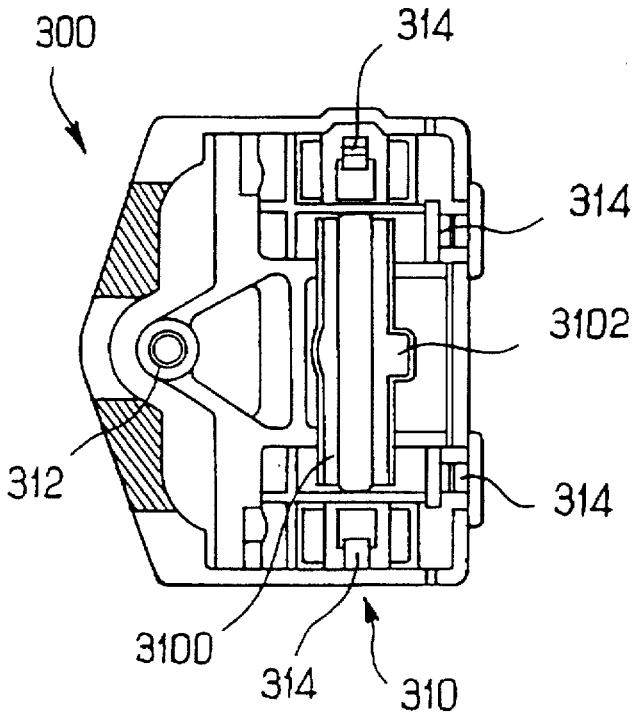
Figure 28:
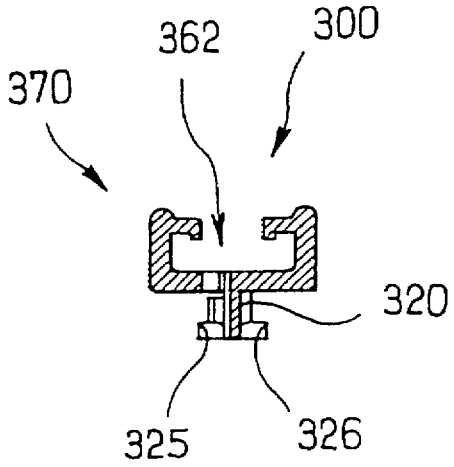

In practice, this leg 370 is integrally molded on the base of the housing 310. In a variant, it may receive an anti-wear part at its own base, e.g. in the form of a disk which actually rests against the bottom of the tank. Such an anti-wear part makes it possible to prevent drift in measurement due to deformation or wear of the leg 370 or of the wall of the tank, in particular under the vibration or of aging of the material from which they are made. One such anti-wear part is shown diagrammatically under the reference 3700 in FIG. 14.

The right cross-section of the leg 370 is preferably cruciform or in the form of a star having four branches inclined at 90° in pairs. These four branches are referenced 371, 372, 373, and 374 in FIG. 18.

Advantageously, each branch 371, 372, 373, and 374 is provided with a respective projecting finger 375, 376, 377, and 378 at its base, which fingers 375 to 378 are designed to rest against the bottom of the tank or to receive the above-mentioned anti-wear part 3700. Naturally, this anti-wear part may either be added to or be integrally molded with the bottom of the leg 370.

To enable the four-branch star to be made, i.e. having branches 371, 372, 373, and 374 together with the associated fingers 375, 376, 377, and 378, by means of a simple mold having two shells, and without requiring complex cores, two of the fingers 375 and 376 are preferably formed in line with the associated branches 371 and 372, whereas the other two fingers 377 and 378 provided on the two branches 373 and 374 that are orthogonal to the two above-mentioned branches 371 and 372 are offset relative to their corresponding support branches 373 and 374 in opposite directions, as can be seen in FIG. 18.

The peg 350 is integrally molded on the top of the housing 310. Its right cross-section is complementary to that of the internal channel in the socket 234 so the peg 350 can be engaged in the socket 234 so as to slide freely therein.

It will be observed that it is preferable for the peg 350 to be provided at its base, i.e. in the vicinity of the top of the housing 310, with a circular collar 352. The purpose of the collar is to act as a thrust surface at the base of the spring 400.

In this way, the spring 400 is engaged on the peg 234 and is held captive between the collar 232 on the receptacle 210 and the collar 352 secured to the peg 350.

It will also be observed, in particular from FIG. 16, that the peg 350 and its collar 352 are provided along the full height thereof with a longitudinal vertical groove 354. This groove makes it possible to reinforce the elasticity of the peg 350 so as to improve guidance in the socket 234. Above all, the groove 354 makes it possible to make the peg 350 with substantially constant wall thickness as is necessary to obtain a part without damaging stresses when molding a plastics material.

The present invention provides numerous advantages over previously known gauging-and-intake devices.

In particular, the present invention makes it possible to place an intake pump inside the receptacle 210 which is stationary relative to the base, and in particular relative to the intake tube 113. The invention thus makes it possible to avoid the conventional piece of flexible hose that would otherwise connect the pump outlet to the tube connected to the base 100 since the pump outlet can now be connected directly thereto. This gives rise to a structure that is simpler than in prior devices, that provides better sealing, and that enables gauging-and-intake assemblies to be made of smaller height. Consequently, it is easier to integrate in fuel tanks which are nowadays relatively low in height.

In addition, the present invention reduces operating noise.

It may be observed that because of the setbacks 230 formed in the receptacle 210, the gauging assembly 300 can be integrated in a cylindrical outer envelope of small diameter, typically of 80 mm for an assembly that includes an electrical pump, and 60 mm for an assembly without a pump.

In FIG. 6, this notional envelope containing the gauging assembly is given reference 500.

The present invention also makes it possible to make a receptacle 210 and/or a gauging assembly 300 that is universal, i.e. that can be reused in various different gauging-and-intake assemblies. The flexibility of the filter or strainer 250 and the sliding displacement allowed to the gauging assembly 300 relative to the reserve receptacle makes it possible to take account not only of the maximum amount of deformation that might occur in the bottom of a tank, but also makes it possible to fit the same intake-and-gauging device of the present invention to tanks of different depths.

For this purpose, it is preferable (although not essential) for the flexibility of the straining filter 250 and for the displacement available to the gauging assembly 300 relative to the reserve receptacle 210 to be of the order of 40 mm to 60 mm.

Finally, it should be observed that the present invention facilitates assembly and disassembly of said assembly. In particular, the invention makes it easy to decouple the gauging assembly 300 from the intake assembly 200. It also makes it possible to facilitate exchanges, in the event of one or other of the two assemblies failing, thereby reducing replacement costs since, in contrast to the past, it is no longer necessary to replace the entire gauging-and-intake assembly.

Naturally, the present invention is not limited to the particular embodiment described above, and it extends to any variant coming within the spirit of the invention.

For example, the disposition of the socket 234 and of the peg 250 can be interchanged, with the peg 250 being on the receptacle 210 while the socket 234 is on the housing 310.

The variant embodiment shown in FIGS. 19 to 28 is now described.

In this variant embodiment, the gauging assembly 300 does not comprise a single part, as in the previous embodiment, but comprises two separate parts: a housing 310 and a support leg 370.

The housing 310 is essentially adapted to support a resistive track 380 that co-operates with a slider associated with the float 392.

The housing 310 comprises a stub axle 312 which serves to guide rotation of the float arm 394. It also comprises teeth 314 designed to fix the support of the resistive track 380.

The support leg 370 has a bottom length 3700, a middle length 360, and a top peg 350.

The middle length 360 carries the guide 320 which is constituted by the wall 322 and the two pairs of oppositively directed fingers 323 & 324 and 325 & 326 which are engaged in the slideway 260 of the receptacle 210.

The guide 320 is provided with a resilient member 330 formed by an arc 332, as described above.

In addition, the middle length 360 includes a setback or hook 340 adapted to co-operate with the tooth 272.

The peg 350 is designed to be engaged in the socket 234. The peg 350 is provided at its base with a collar 352 that serves as a bearing surface for the spring 400, and it is provided along its length with a groove 354.

The spring 400 urges the supporting leg 370 towards the bottom of the tank.

In the variant shown in FIGS. 19 to 28, the base of the bottom length 3700 tapers downwards so that said bottom length 3700 rests against the bottom of the tank via a zone 3702 of small size.

The housing 310 is also adapted to be fixed in a predetermined position on the support leg 370 by any appropriate means, e.g. by snap-fastening.

To this end, in the non-limiting embodiment shown in FIGS. 19 to 28, the housing 310 is provided with a guide 3100 of T-shaped right cross-section which is adapted to be engaged in a complementary slideway having converging edges 362 and provided on the middle length 360. The guide 3100 and the slideway 362 extend vertically. They are held in a particular relative position by a tooth 3102 projecting laterally from the guide 3100, and adapted to engage in a complementary housing 364 that opens out into the housing 362.

The variant shown in FIGS. 19 to 28 makes it possible to provide a plurality of support legs 370 of different lengths that are adapted to tanks of different respective depths, and to use these different support legs 370 in association with a standard housing 310.

We claim:

1. An intake-and-gauging device for the fuel in a motor vehicle, the device comprising a fixing base designed to be fixed on a wall of a fuel tank and carrying an intake assembly provided with a reserve receptacle and a gauging assembly, wherein the gauging assembly is slidably mounted in a generally vertical direction on the reserve receptacle and is resiliently urged towards the bottom of the fuel tank relative to said receptacle.

2. A device according to claim 1, wherein the gauging assembly is received in a setback formed on the outside surface of the reserve receptacle.

3. A device according to claim 1, wherein the reserve receptacle has a vertical slideway formed by a groove of generally rectilinear right cross-section and having symmetrical converging edges.

4. A device according to claim 1, wherein the receptacle has a slideway which is closed at its top end.

5. A device according to claim 1, wherein the slideway has a resilient tooth at one of its ends, which is adapted to prevent the gauging assembly being accidentally withdrawn.

6. A device according to claim 1, wherein the reserve receptacle carries a vertical socket at its top.

7. A device according to claim 1, wherein the gauging assembly comprises a central housing, a bottom leg and a top peg.

8. A device according to claim 7, wherein the base of the leg tapers.

9. A device according to claim 1, wherein the gauging assembly is provided on one of its faces with a guide adapted to be held captive while still being slidably guided in a slideway provided on the reserve receptacle.

10. A device according to claim 9, wherein the guide comprises a rectilinear wall provided at its ends and at its outer edge with pairs of projecting fingers for forming a guide of T-shaped right section at its ends.

11. A device according to claim 9 wherein the guide also includes a resilient structure baring against one of the flanks of the slideway provided on the reserve receptacle.

12. A device according to claim 11, wherein the resilient structure is formed by an arc that is generally in the form of a cylindrical sector integrally molded with and connected to the wall of the guide, via the ends of the arc.

13. A device according to claim 1, wherein the gauging assemble includes a setback suitable for serving as a bearing surface for a resilient finger integrally molded on the reserve receptacle and facing a slideway.

14. A device according to claim 1, wherein the gauging assembly comprises a central housing, a bottom leg and a top peg, and wherein the leg has a right cross-section that is star-shaped.

15. A device according to claim 14, wherein each branch of the leg is provided with a projecting finger at its base.

16. A device according to claim 15 wherein the leg possesses a four-branch star each branch being provided with a projecting finger at its base, two of the fingers provided on two diametrically opposite branches being in line therewith, while the other two fingers provided on the ether two branches are offset in opposite directions relative thereto.

17. A device according to claim 1, wherein the gauging assembly comprises a central housing, a bottom leg and a top peg, and wherein the peg is provided at its base with a collar.

18. A device according to claim 1, wherein the gauging assembly comprises a central housing, a bottom leg and a top peg, and wherein the right cross-section of the peg is smaller than the right cross-section of a channel formed in a socket integrally molded on the reserve receptacle.

19. A device according to claim 1, wherein a spring is interposed between the reserve receptacle and the gauging assembly.

20. A device according to claim 1, wherein the gauging assembly is made of two parts: a housing suitable for receiving a support for a resistive track; and a support leg.

21. A device according to claim 20 wherein the housing is fixed in a predetermined position on the support leg and the support leg is guided in vertical displacement on the reserve receptacle.

22. A device according to claim 20, wherein the housing includes a T-shaped guide engaged in a slideway having converging edges formed in the support leg, and a projection suitable for fixing the position of the housing on the support leg.

23. A device according to claim 1, wherein the housing is made in the form of a single standard model whereas the support leg is provided in a plurality of lengths adapted to tanks of different depths.

24. A device according to claim 1, wherein the reserve housing is snap-fastened onto a skirt of the fixing base.

25. A device according to claim 1, wherein the displacement allowed to the gauging assembly relative to the reserve receptacle is of the order of 40 mm to 60 mm.

26. A device according to claim 1, wherein the reserve receptacle is provided at its base with a strainer having flexibility that is adapted to allow deformation over an amplitude that is not less than the maximum amplitude of deformation of the bottom wall of the fuel tank, and wherein the flexibility of the strainer is adapted to allow movement of the order of 40 mm to 60 mm.

27. An intake-and-gauging device for the fuel in a motor vehicle, the device comprising a fixing base designed to be fixed on a wall of a fuel tank and carrying an intake assembly provided with a reserve receptacle and a gauging assembly, wherein the gauging assembly is slideably mounted in a generally vertical direction on the reserve receptacle and is resiliently urged towards the bottom of the fuel tank relative to said receptacle, and the reserve receptacle is provided at its base with a strainer having flexibility that is adapted to allow deformation over an amplitude that is not less than the maximum amplitude of deformation of the bottom wall of the fuel tank.

28. A device according to claim 27, wherein the strainer is associated with a resilient structure which urges said strainer against the bottom of the fuel tank.

29. A device according to claim 28, wherein the resilient structure is constituted by a helical spring.

30. A device according to claim 28 wherein the resilient structure is formed by a tab integrally molded on the reserve receptacle and placed in the strainer.

31. A device according to claim 27, wherein the gauging assembly is received in a setback formed on the outside surface of the reserve receptacle.

32. A device according to claim 27, wherein the reserve receptacle has a vertical slideway formed by a groove of generally rectilinear right cross-section and having symmetrical converging edges.

33. A device according to claim 27, wherein a spring is interposed between the reserve receptacle and the gauging assembly.

34. A device according to claim 27, wherein the gauging assembly is made of two parts: a housing suitable for receiving a support for a resistive track; and a support leg.

35. A device according to claim 34, wherein the housing is fixed in a predetermined position on the support leg and the support leg is guided in vertical displacement on the reserve receptacle.

36. A device according to claim 34, wherein the housing includes a T-shaped guide engaged in a slideway having converging edges formed in the support leg, and a projection suitable for fixing the position of the housing on the support leg.

37. A device according to claim 27, wherein the displacement allowed to the gauging assembly relative to the reserve receptacle is of the order of 40 mm to 60 mm.

38. A device according to claim 27, wherein the reserve receptacle is provided at its base with a strainer having flexibility that is adapted to allow deformation over an amplitude that is not less than the maximum amplitude of deformation of the bottom wall of the fuel tank, and wherein the flexibility of the strainer is adapted to allow movement of the order of 40 mm to 60 mm.

* * * * *

UNITED STATES PATENT AND TRADEMARK OFFICE

CERTIFICATE OF CORRECTION

PATENT NO. : 5,678,449

DATED : October 21, 1997

INVENTOR(S) : Mollet et al.

It is certified that error appears in the above-identified patent and that said Letters Patent is hereby corrected as shown below:

In column 1, at line 10, please delete "general , such devices comprises" and insert --general, such devices comprise--.

In column 1, at line 13, please delete "the" and insert --The--.

In column 1, at line 21, please delete "unprimimg" and insert --unpriming--.

In column 1, at line 22, please delete "proposals" and insert --Proposals--.

In column 6, at line 39, please delete "part 3700" and insert --part 370--.

In claim 11, at line 2, please delete "baring" and insert --bearing--.

Signed and Sealed this

Tenth Day of August, 1999

*Attest:*

*Attesting Officer*

Q. TODD DICKINSON

*Acting Commissioner of Patents and Trademarks*